US005087029A

United States Patent [19]

Sugishima

[11] Patent Number: 5,087,029

[45] Date of Patent: Feb. 11, 1992

[54] SORTER HAVING NOISE-ELIMINATING MEMBER

[75] Inventor: Yoshio Sugishima, Osaka, Japan

[73] Assignee: Mita Industrial Co., Ltd., Osaka, Japan

[21] Appl. No.: 655,188

[22] Filed: Feb. 13, 1991

Related U.S. Application Data

[63] Continuation of Ser. No. 365,799, Jun. 14, 1989, abandoned.

[30] Foreign Application Priority Data

Jun. 17, 1988 [JP] Japan ..... 63-80747[U]
Jul. 2, 1988 [JP] Japan ..... 63-65239[U]

[51] Int. Cl.[5] ..... B65H 39/11
[52] U.S. Cl. ..... 271/293; 271/294
[58] Field of Search ..... 271/292, 293, 294, 299; 74/443; 248/638, 595, 596, 598, 633; 267/269, 263, 265, 158, 160

[56] References Cited

U.S. PATENT DOCUMENTS

| | | | |
|---|---|---|---|
| 1,497,152 | 6/1924 | Masury et al. | 267/269 |
| 2,155,073 | 4/1939 | Ziska | 267/269 |
| 2,955,481 | 10/1960 | Jackel | 74/443 |
| 3,461,737 | 8/1969 | Lukawich et al. | 74/443 |
| 3,901,496 | 8/1975 | Chambers | 267/160 |
| 4,343,463 | 8/1982 | Lawrence | 271/293 |
| 4,603,850 | 8/1986 | Horiuchi . | |
| 4,620,247 | 10/1986 | Papaciak et al. | 267/158 |
| 4,621,803 | 11/1986 | Johdai et al. | 271/294 |
| 4,842,264 | 6/1989 | Kosaka et al. | 271/293 |
| 4,863,155 | 9/1989 | Irie | 271/294 |

FOREIGN PATENT DOCUMENTS

| | | |
|---|---|---|
| 4856 | 1/1957 | Japan . |
| 67454 | 9/1959 | Japan . |
| 2145066 | 3/1985 | United Kingdom . |
| 2193489 | 2/1988 | United Kingdom . |

*Primary Examiner*—H. Grant Skaggs
*Attorney, Agent, or Firm*—Stevens, Davis, Miller & Mosher

[57] ABSTRACT

A sorter comprising plural movable bin trays vertically arranged, a shifting mechanism for moving one ends of the bin trays upwardly or downwardly one after another and a holder for accommodating the other ends of the bin trays. Noise eliminating members or elastic members are provided at at least one portion of a contacting portion of the shifting mechanism with the bin trays and a contacting portion of each of the bin trays with the shifting mechanism, and/or in the holder.

15 Claims, 7 Drawing Sheets

SORTER HAVING NOISE-ELIMINATING MEMBER

This application is a continuation of application Ser. No. 365,799, filed June 14, 1989 now abandoned.

BACKGROUND OF THE INVENTION

This invention relates to a sorter with which sheets discharged from an image forming machine such as an electrostatic copying machine or printing machine are sorted out as required and collected, and more particularly to a sorter in which sound noises produced in sorting out such sheets is prevented.

For one example of a sorter in which recording sheets are distributed and received with bin trays which is allowed to move up and down, Japanese Patent unexamined published Application No. 4856/1982 discloses a sorter having a spiral rotary cam mechanism. In this mechanism, trunnions which are circular pins in section are provided at both sides of the upstream end (or sheet receiving end) of each of the bin trays in such a manner as to protrude in a direction of width, and the trunnions thus protruded are moved up and down by cylindrical cams having cylindrical outer walls in which trunnion receiving grooves are spirally formed. In order to allow the trunnion receiving grooves to receive the trunnions successively, the mechanism thus constructed is required to have elastic deflecting means for elastically deflecting the trunnions towards the cams.

Therefore, the resultant mechanism is intricate in construction and is accordingly high in manufacturing cost.

However, the elastic deflecting means may be eliminated by provision of a mechanism for allowing the cams to act directly on the bin trays.

FIG. 1 is an explanatory diagram showing the mechanism. In the mechanism as shown in FIG. 1, bin trays 3-1 and 3-2 include protruded portions which are driven by cams described later, and ring-shaped cams 5-1 and 5-2 are provided for the bin trays in such a manner that they are rotatable about a central axis extended in a predetermined direction and are moved back and forth along the central axis when turned. The ring-shaped cams are designed such that the protrusion length thereof in the front direction along the central axis is gradually increased in a circumferential direction from a predetermined angular position. In moving the bin try upwardly, the cams are rotated to move towards the bin tray; and in moving the bin tray downwardly, they are rotated to move away from the bin tray. Thus, the cams act directly on the lower surfaces of the protruded portions of the bin tray to move the latter upwardly or downwardly.

In the sorter thus constructed, when moving the bin tray upwardly or downwardly, the ring-shaped cams abut against the protruded portions of the bin tray, and then the protruded portions are moved upwardly or downwardly while held by the ring-shaped cams, so that noises are produced.

In a sorter in which recording sheets are distributed and received with a plurality of bin trays moved up and down, as disclosed, for instance, by Japanese Patent Application (OPI) No. 167454/1984, the end portions of the bin trays are inserted respectively in receiving spaces provided in a holder. Accordingly, when the bin tray is moved up and down in the sorter thus constructed, its end portion is vibrated in the receiving space in the holder, thus striking against the upper and lower walls defining the receiving space, to produce noises.

SUMMARY OF THE INVENTION

In view of of the foregoing, an object of this invention is to provide a sorter in which the production of noises caused when the bin trays, being moved upwardly or downwardly, strike or contact other components is prevented.

The foregoing object and other objects of the invention have been achieved by the provision of (1) a sorter comprising: a plurality of movable bin trays arranged stacked one on another; and a shifting mechanism for moving the bin trays upwardly or downwardly one after another, in which, according to a first aspect of the invention, noise eliminating members are provided on the lower surfaces of the bin trays against which the shifting member abuts, (2) a sorter comprising: a plurality of movable bin trays arranged stacked one on another; and a shifting mechanism for moving the bin trays upwardly or downwardly one after another, in which, according to a second aspect of the invention, the bin trays include protruded portions which are protruded in predetermined directions in such a manner that the protruded portions are larger in the length of protrusion from the lowermost bin tray towards the uppermost bin tray, the shifting mechanism includes ring-shaped cams confronted with the protruded portions, and arranged rotatable around central axes extended in the predetermined directions and movable along the central axes, each ring-shaped cam being gradually increased in the length of protrusion along the central axis, circumferentially starting from a predetermined angular position thereon, and drive means for turning the cams in one direction to move the cams towards each other along the central axis, and turning the cam in the opposite direction to move the cams away from each other along the central axis, and a noise eliminating member is provided at the maximumly protruded part of the ring-shaped cam, and (3) a sorter comprising: a plurality of movable bin trays arranged stacked one on another; and a shifting mechanism for moving the bin trays upwardly or downwardly one after another, in which, according to a third aspect of the invention, receiving means for receiving the end portions of the bin trays which are opposite to the end portions of the bin trays against which the shifting mechanism abuts is provided with noise eliminating members for preventing the vibration of the bin trays.

DETAILED DESCRIPTION OF THE INVENTION

Preferred embodiment of this invention will be described with reference to the accompanying drawings.

Figure 1:
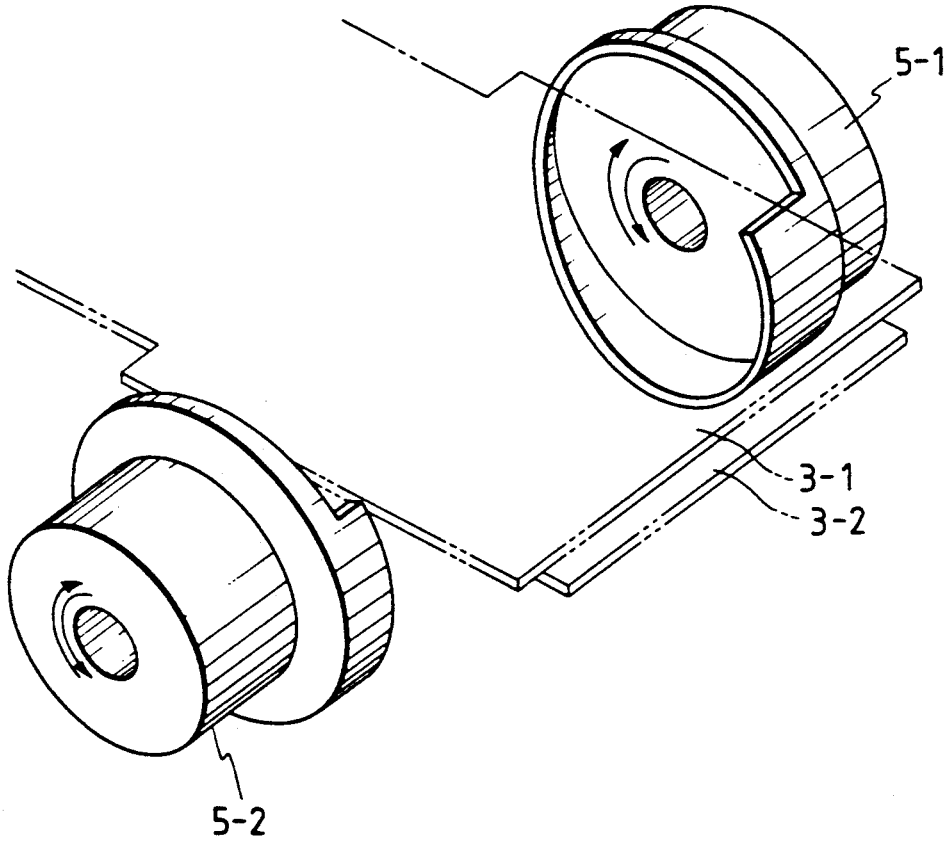
FIG. 1 is a perspective view showing a bin tray displacing mechanism including cams.
Figure 2:
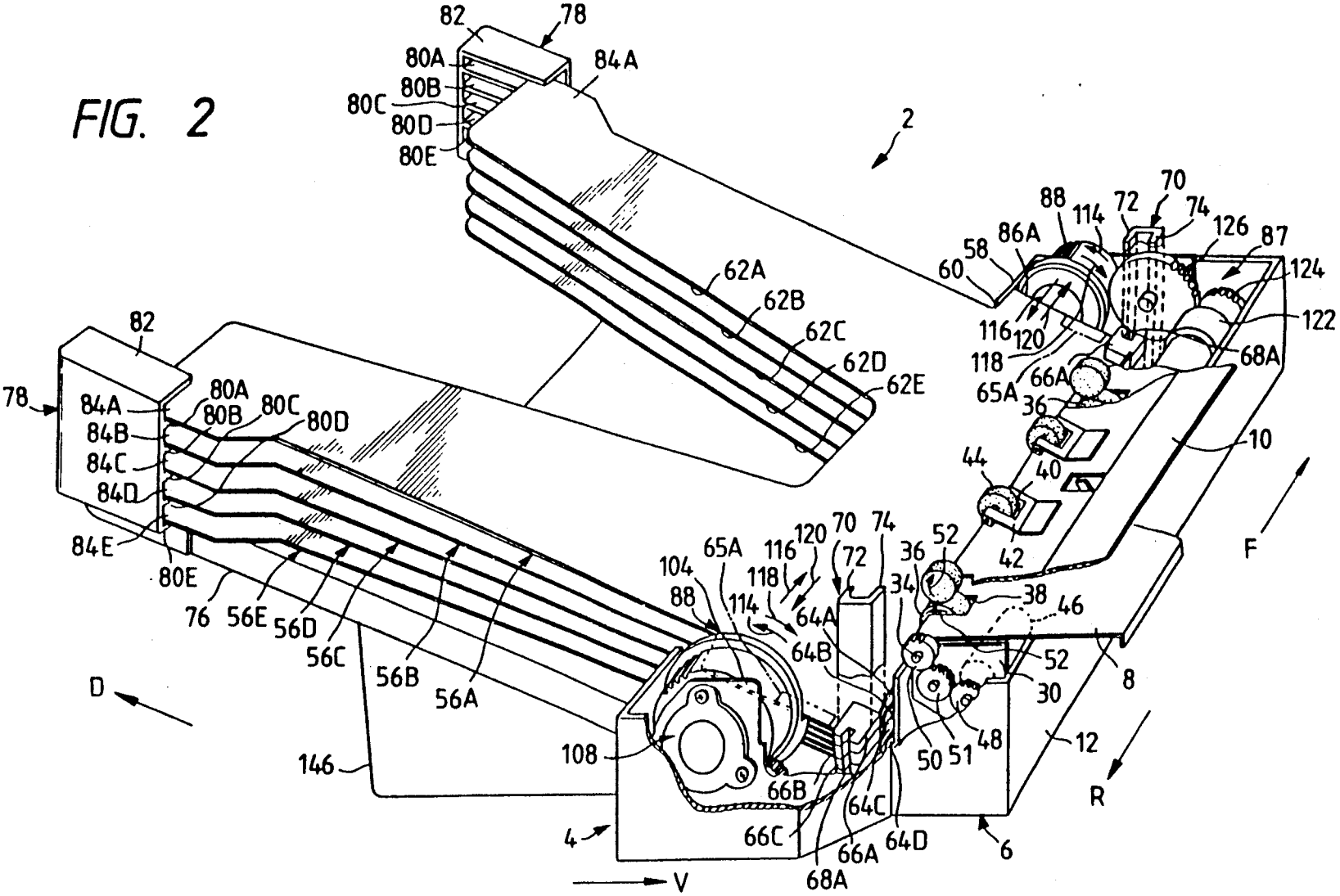
FIG. 2 is a perspective view showing a first example of a sorter according to this invention.
Figure 3:
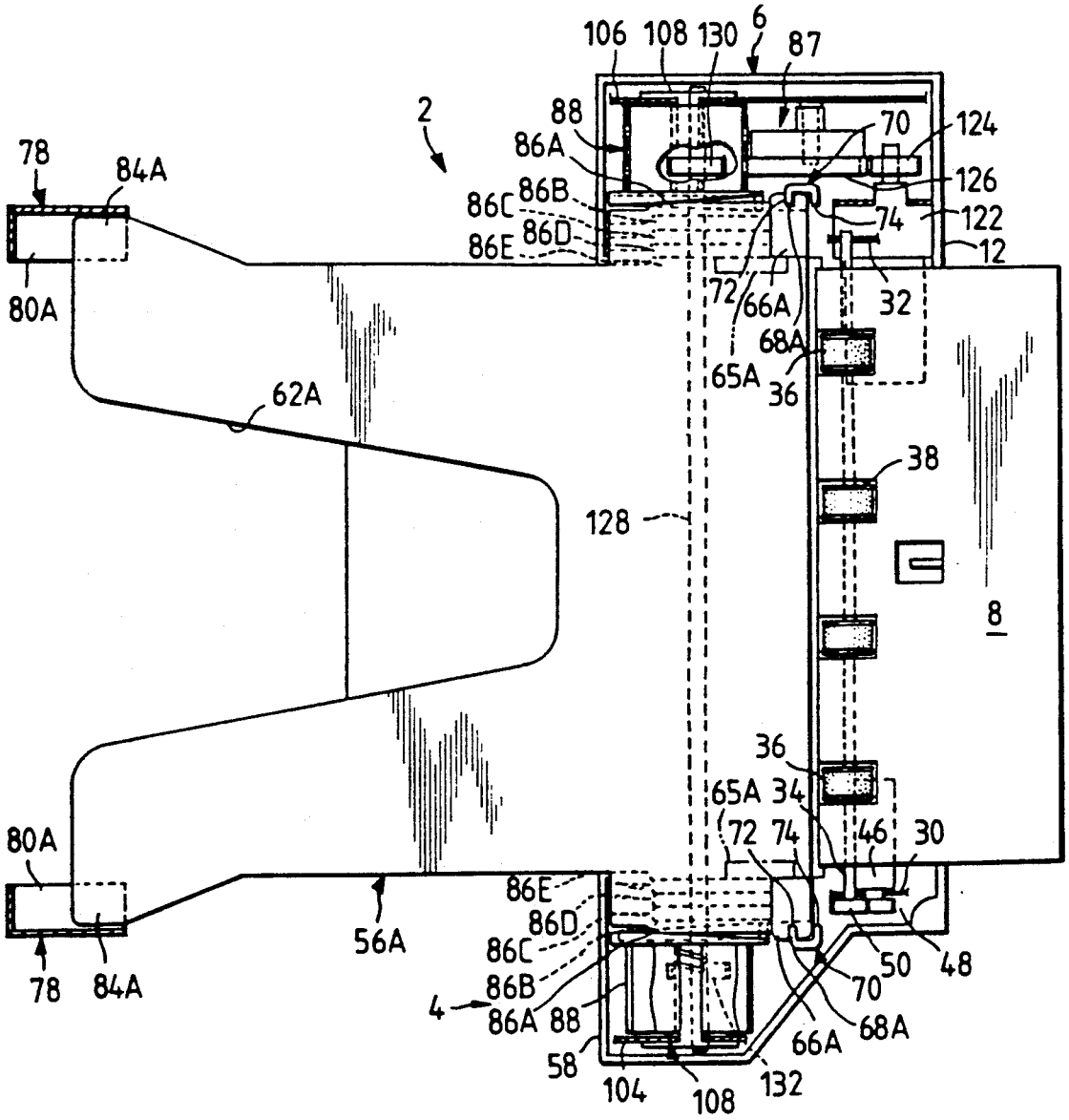
FIG. 3 is a top view of the sorter as shown in FIG. 1.

As shown in FIGS. 2 and 3, a sorter 2 includes a stationary supporting frame 4 having a box-shaped member 6 whose top is open. Further, a pair of guide boards, namely, an upper guide board 10 and a lower guide board 8 are provided at the upstream side of the box-shaped member 6 (to the direction of the arrow U in FIG. 2, or on the right-handed side in FIG. 4). The major portion of the lower guide board 8 is extended substantially horizontally along the top surface of the box-shaped member 6, and the upstream portion thereof is extended over the upstream end wall 12 of the box-shaped member 6. The lower guide board 8 thus constructed can be secured to the upstream wall 12 of the box-shaped member 6 with a suitable means (not shown). The upstream portion of the upper guide board 10 positioned above the lower guide board 8 is extended in such a manner that it is slightly inclined upwardly in to the direction of the arrow U (hereinafter referred to "an upstream direction", when applicable). Legs (not shown) extended downwardly from the front and rear edges of the upper guide board 10 are coupled to the lower guide board 8 so that the upper guide board 10 is secured in position.

Figure 4:
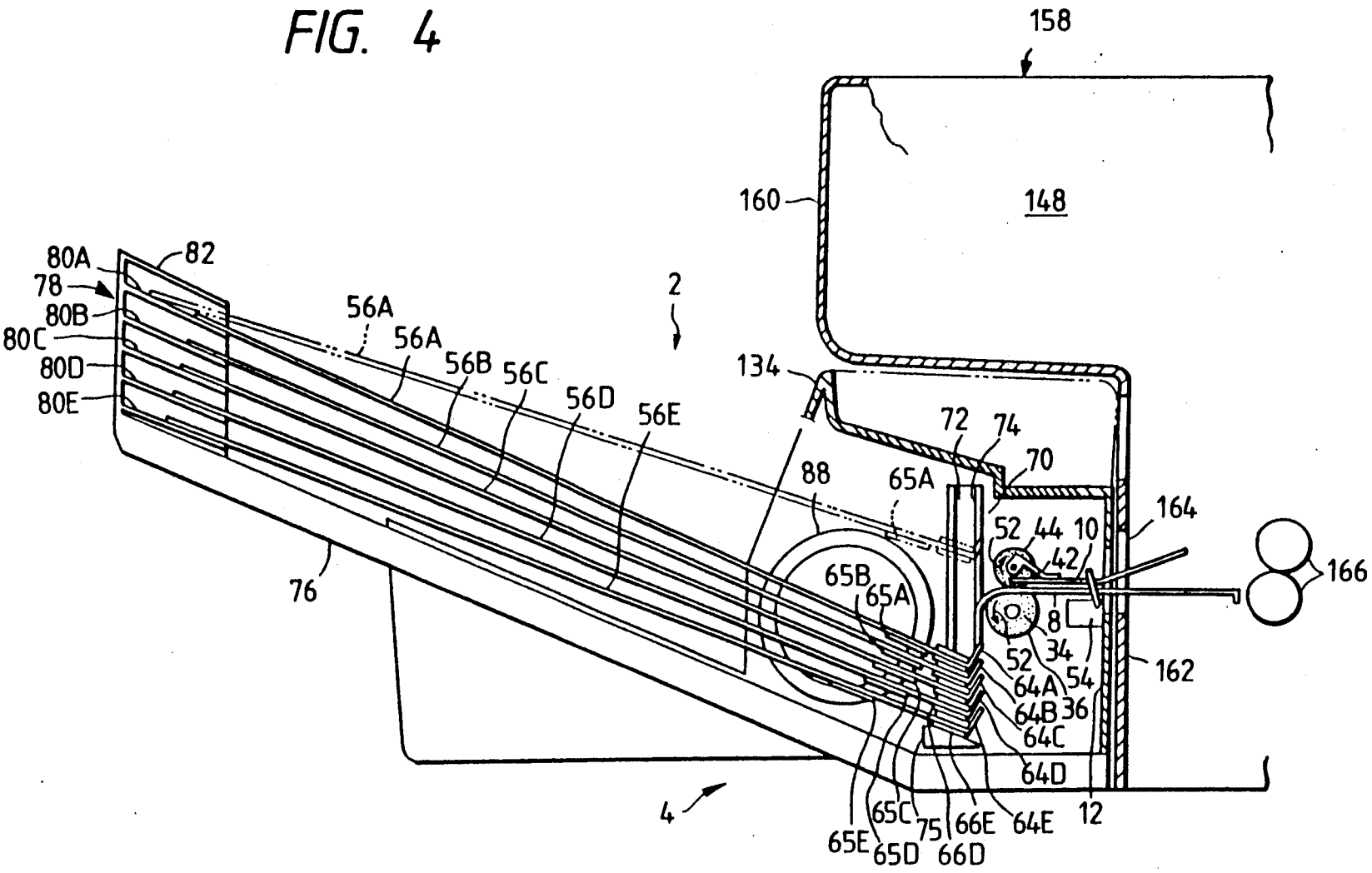
FIG. 4 is a cross-sectional view showing the sorter together with an image forming machine.

In the upstream space in the box-shaped member 6 of the supporting frame 4, there are provided supporting members 30 and 32 in such a manner that they are spaced from each other in the lateral direction (or in the direction of the arrow F or R in FIG. 2, in a vertical direction in FIG. 3, or in a direction perpendicular to the drawing of FIG. 4). A supporting shaft 34 is rotatably supported between the supporting members 30 and 32 in such a manner that it is extended substantially horizontally in the lateral direction (in the direction of the arrow F or R). A plurality of rollers 36 (four rollers in the embodiment) are fixedly mounted on the supporting shaft 34 at suitable intervals. A plurality of cuts 38 (four cuts in the embodiment) are formed so as to be spaced at intervals in the lateral direction at the downstream end portion of the lower guide board 8 (hereinafter the direction of the arrow D in FIG. 2 will be referred to as "a downstream direction", when applicable), and the above-described rollers 36 are protruded above the lower guide board 8 through the cuts 38. As shown in FIG. 2, a plurality of cuts 40 (four cuts in the embodiment) are formed at intervals in the lateral direction at the downstream end portion of the upper guide board 10 such that the cuts 40 confront the cuts 38 formed in the lower guide board 8. Supporting pieces 42 made of leaf springs are arranged on the upper surface of the upper guide board 10 in such a manner that they are located beside the cuts 40, respectively. Each of the supporting pieces 42 comprises: a base portion which is secured to the upper surface of the upper guide board 10, for instance, by welding; and a two-prong-fork-shaped supporting portion which is slightly inclined upwardly in the downstream direction. A driven roller 44 is rotatably supported between the two prongs of the fork-shaped portions. The rollers 44 thus supported are protruded below the upper guide board 10 through the cuts 40, and are elastically abutted against the rollers 36 by the elastic forces of the supporting pieces 42.

As shown in FIGS. 2 and 3, a drive source 46, which may be an electric motor, is coupled to the above-described supporting member 30, and a gear 48 is fixedly mounted on the output shaft of the drive source 46. A gear 50 is fixedly mounted on the front end portion of the supporting shaft 34, on which the rollers 36 is fixedly mounted. The gear 50 is interlocked to the above-described gear 48 through a gear 51 which is rotatably supported on the supporting member 30 (FIG. 2). Hence, as the drive source 46 is energized, the supporting shaft 34 is rotated in the direction of the arrow 52 (FIG. 4) through the gears 48, 51 and 50, and then the rollers 36 and 44 are rotated in the directions of the arrows 52 (FIG. 4). As is clearly shown in FIG. 4, a detector 54 such as a microswitch or the like is provided in the upstream space in the box-shaped member 6 of the supporting frame 4 in order to detect a sheet passed between the upper guide board 10 and the lower guide board 8.

The sorter 2, as shown in FIGS. 2 through 4, has vertically-arranged plural bin trays (five bin trays in the embodiment) 56A through 56E each of which may be substantially in the form of a rectangular plate. The bin trays 56A through 56E are extended in the downstream direction through a large cut 60 (FIG. 2) formed in the downstream end wall 58 of the box-shaped member 6, with their upstream end portions disposed in the box-shaped member 6 of the supporting frame 4. As shown in FIG. 4, the bin trays 56A through 56E are upwardly inclined to the downstream direction. Relatively large trapezoid cuts 62A through 62E are formed in the downstream end portions of the bin trays 56A through 56E which are protruded from the box-shaped member 6, in such a manner that, in each bin tray, the cuts spread from the downstream edge to the central portion. Thus, each of the bin trays is substantially U-shaped having two legs. As shown in FIGS. 2 and 4, the bin trays 56A through 56E have protruded pieces 64A through 64E at the upstream ends in such a manner that the vertically protruded pieces 64A through 64E are so arranged as to be spaced at suitable intervals. Substantially rectangular stacking blocks 66A through 66E which are guided (hereinafter referred to as "guided stacking blocks" when applicable) are secured to the front and rear ends of the upstream edges of the bin trays 56A through 56E, respectively. The stacking blocks 66A through 66E are extended laterally outwardly of the bodies of the bin trays 56A through 56E, and have substantially rectangular guided cuts 68A through 68E in their outer end portions, respectively.

On the other hand, front and rear guide means 70 are arranged in the box-shaped member 6 of the supporting frame 4 in such a manner that they are spaced from each other at a predetermined interval. Each of the guide means 70 is substantially U-shaped in cross section and has two legs 72 and 74 which are extended substantially vertically. The guided cuts 68A through 68E formed in the blocks 66A through 66E of the bin trays 56A through 56E are engaged with the first legs 72 of the guide means 70, so that they are stacked one on another and moved vertically along the legs 72. As shown in FIG. 4, a receiving stand 75 whose upper surface is upwardly inclined to the downstream direction is provided below the guide means 70. The block 66E of the lowermost bin tray 56E is laid on the receiving stand 75, and the blocks 66D, 66C, 66B and 66A of the remaining bin trays 56D, 56C, 56B and 56A are stacked on the block 66E of the lowermost bin tray 56E in the stated order. When the blocks 66A through 66E are stacked one on another as shown by the solid lines in FIG. 4, the upstream end portions of the bin trays 56A through 56E are vertically spaced apart from one another at the interval prescribed by the thickness of the blocks 66A through 66E. In the embodiment, the upstream end portion of the lowermost bin tray 56E, similarly as in those of the remaining bin trays 56A through 56D, is slidably engaged with the guide means 70 through the blocks 66E. However, it is not always necessary to move the lowermost bin tray 56E vertically; that is, the lowermost bin tray may be fixed in position.

Noise eliminating members 65A through 56E, which comprise polyurethane rubber or the like, are provided on the lower surfaces of the bin trays 56A through 56E at the parts on which cam members 88 (described later) act.

As shown in FIGS. 2 and 4, the stationary supporting frame 4 has protruded parts 76 which are extended from the front and rear ends of the bottom of the box-shaped member 6 in such a manner that they are upwardly inclined to the downstream direction. At the downstream ends of the protruded parts, supporting frame units 78 (holders) are provided. Each of the supporting frame units 78 has a plurality of supporting walls (five supporting walls in the embodiment) 80A through 80E and an upper wall 82 which are arranged at predetermined intervals in such a manner that they are in parallel with one another and inclined to the downstream direction.

On the other hand, as shown clearly in FIGS. 2 and 3, the bin trays 56A through 56E have portions 84A through 84E which are extended from the front and rear ends of the downstream end portions laterally (in the directions of the arrows F and R). The portions 84A through 84E of the bin trays 56A through 56E are supported on the supporting walls 80A through 80E of the supporting frame units 78, respectively, so that the downstream end portions of the bin tray 56A through 56E are supported by the supporting frame units 78. When the upstream portions of the bin trays 56A through 56E are moved upwardly or downwardly (as described later), the supported portions 84A through 84E of the bin trays 56A through 56E are moved longitudinally and slightly turned with respect to the supporting walls 80A through 80E, respectively.

The bin trays 56A through 56E have protruded portions 86A through 86E extended from the front and rear ends of the upstream end portions thereof (located at the downstream side of the stacking blocks 66A through 66E). Each of the protruded portions 86A through 86E may be provided integral with the bin trays, or may be provided separately therefrom. As shown best in FIG. 7, the protruded portions 86A through 86E are larger in widthwise length from the lowermost bin tray towards the uppermost bin tray stepwise; that is, the widthwise protruded lengths LA through LE of the protruded portions 86A through 86E are decreased stepwise by a value x in the stated order. In other words, $LA=LB+x$; $LB=LC+x$; $LC=LD+x$; and $LD=LE+x$.

Noise eliminating members 65A through 65E which comprise polyurethane rubber or the like are provided on the lower surfaces of the protruded portions 86A through 86E, respectively.

The sorter 2 thus constructed further comprises a shifting mechanism 87 which acts on the noise eliminating members 65A through 65E provided on the lower surfaces of the protruded portions 86A through 86E, to move the bin trays 56A through 56E upwardly or downwardly one after another. The noise eliminating members may be provided on the entire lower surfaces of the bin trays, or on the lower surfaces of the protruded portions provided for the latter. The shifting mechanism 87 comprises a front cam member 88 provided in front of the protruded portions 86A through 86E on the front side of the bin trays 56A through 56E; and a rear cam member 88 provided at the rear of the protruded portions 86A through 86E on the rear side of the bin trays 56A through 56E.

Figure 5:
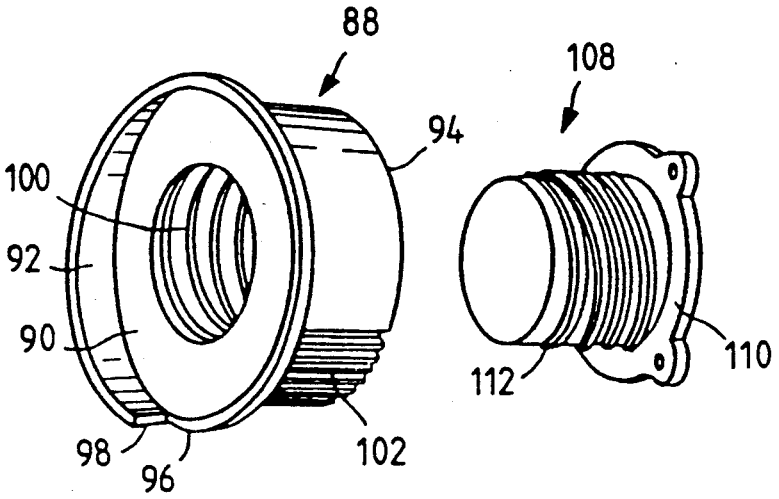
FIG. 5 is a perspective view showing a cam member and a male-threaded rod used in the sorter as shown in FIG. 2.
Figure 7:
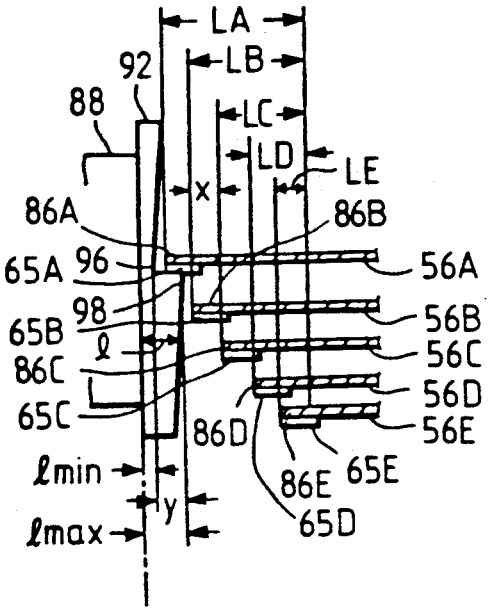
FIGS. 7 through 10 are cross-sectional views of bin trays and cams for explaining the operation of the sorter as shown in FIG. 2.
Figure 11:
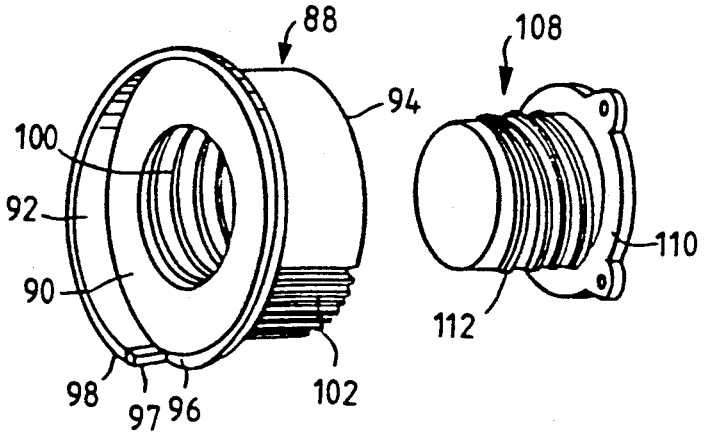
FIG. 11 is a perspective view of the cam member having a noise-eliminating member.

Each of the front and rear cam members 88, as shown in FIG. 5, comprises: an annular plate 90; a ring-shaped cam 92 formed on one surface of the annular plate 90 which is the inner surface as viewed laterally of the sorter; and a cylindrical support part 94 formed on the other surface of the annular plate 90 which is the outer surface as viewed laterally of the sorter. The ring-shaped cam 92 is protruded from the inner surface of the annular plate 90 inwardly as viewed in the widthwise direction. The length of protrusion (1) of the ring-shaped cam 92 is gradually increased from the minimum value $l_{min}$ at a predetermined angular position 96 to the maximum value $l_{max}$ at the angular position 98 which is substantially 360° away from the predetermined angular position in a predetermined direction of rotation (in the case of the rear cam member 88, counterclockwise facing the cam 92; and in the case of the front cam member 88, clockwise facing the cam 92) as shown in FIG. 7. As shown in FIG. 11, a noise eliminating member 97 may be provided at the angular position 98.

The difference y between the above-described minimum and maximum lengths $l_{min}$ and $l_{max}$ ($y=l_{max}-l_{min}$) is substantially equal to the predetermined length x provided for the protruded portions 86A through 86E of the bin trays 56A through 56E (which is the difference between the lengths of protrusion of any two adjacent protruded portions). The cylindrical support part 94 is extended from the cuter surface of the annular plate 90 outwardly, and it is coaxial with the ring-shaped cam 91. The cylindrical inner wall 100 of the cylindrical support part 94 is female-threaded as shown in FIGS. 5 and 11. And a gear 102 is formed on the cylindrical outer wall of the cylindrical support part 94.

Referring to FIGS. 2, 3 and 5, vertical supporting members 104 and 106 are provided in the box-shaped member 6 of the supporting frame 4 in such a manner that the former member 104 is located at the foremost position, and the latter member 106 is at the rearmost position in the box-shaped member 6. Stationary front and rear male-threaded rods 108 are fixedly secured to the supporting members 104 and 106, respectively. As shown clearly in FIG. 5, each of the male-threaded rod 108 is made up of a coupling flange 110, and its body 112 having the cylindrical outer wall on which the male threads are formed. The coupling flanges 110 are secured to the supporting members 104 and 106, and the bodies 112 are extended inwardly through the openings formed in the supporting members 104 and 106 so that they are held substantially horizontally. As shown in FIGS. 2 and 3, the cylindrical support parts 94 of the front and rear cam members 88 are threadably engaged with the rods 108. The male-thread of the male-threaded rods 108 and the female-thread of the cylindrical support part 94 are so designed that, as the cam member 88 makes one revolution, the latter 88 is moved by the above-described value y (which is the distance between the maximum value $l_{max}$ and the minimum value $l_{min}$ of the cam 92) forwardly (i.e., inwardly in the widthwise direction) or backwardly (i.e., outwardly in the widthwise direction). The female thread of the rear cam member 88, and the male thread of the rear male-threaded rod 88, as shown in FIG. 5, are cut in the same direction as the ordinary thread; on the other hand, the female thread of the front cam member 88 and the male thread of the front male-threaded rod 88 are cut in the direction opposite to the ordinary thread. Therefore, when the front and rear cam members 88 are rotated in the direction of the arrow 114, they are moved inwardly in the widthwise direction as indicated by the arrows 116; and when rotated in the direction of the arrow 118, they are moved outwardly as indicated by the arrows 120.

Figure 6:
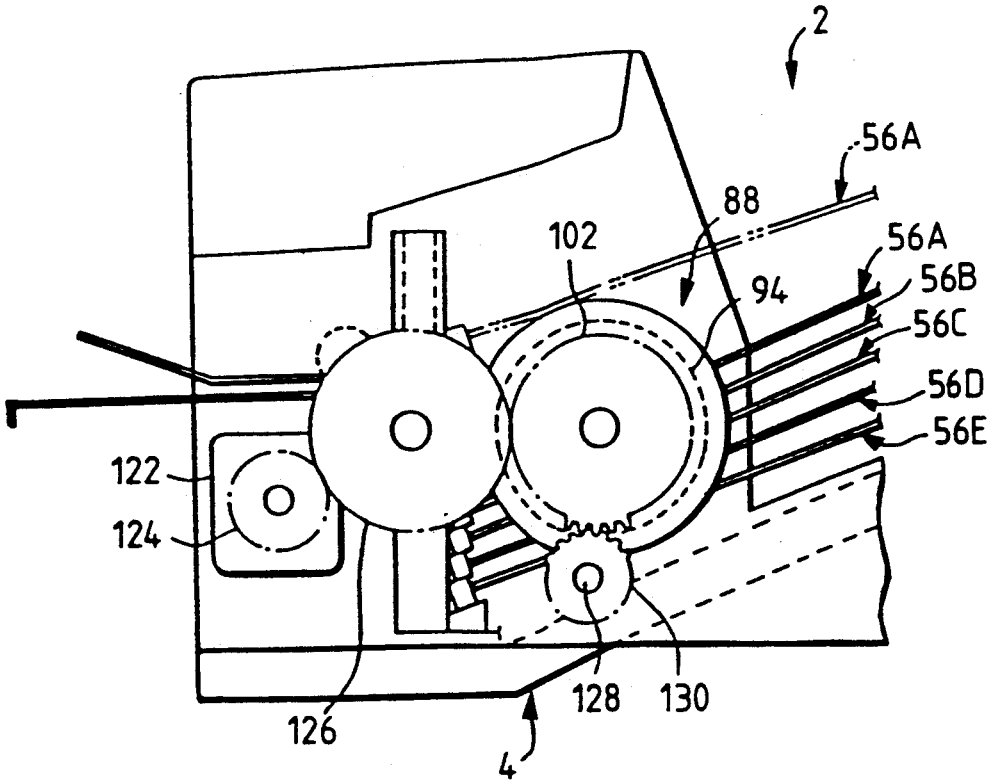
FIG. 6 is a cross-sectional view for explaining the drive system of a shifting mechanism in the sorter as shown in FIG. 2.

As shown in FIGS. 2, 3 and 6, a drive source 122, which may be an electric motor, is provided in the box-shaped member 6 of the supporting frame 4. A gear 124 is mounted on the output shaft of the drive source 122. The gear 124 is interlocked through a gear 126 rotatably mounted or the above-described vertical supporting member 106 to the gear 102 formed on the cylindrical outer wall of the cylindrical support part 94 of the rear cam member 88. On the other hand, a shaft 128 is rotatably supported between the vertical supporting members 104 and 106 in such a manner that it is extended substantially horizontally below the lowermost bin tray 56E. A gear 130 is fixedly mounted on the rear end portion of the shaft 128 and is engaged with the above-described gear 102 of the rear cam member 88. Similarly, a gear 132 is fixedly mounted on the front end portion of the shaft 128 and is engaged with the gear 102 of the front cam member 88. Hence, as the drive source 122 is rotated in the forward direction, the rear cam member 88 is rotated in the direction of the arrow 114 through the gears 124 and 126, while the front cam member 88 is rotated in the direction of the arrow 114 through the gear 130, the shaft 128 and the gear 132 in synchronization with the rear cam member 88. When the drive source 122 is rotated in the reverse direction, the rear cam member 88 and the front cam member 88 are rotated in the directions of the arrows 118 in synchronization with each other.

The operation of the sorter 2 thus constructed will be described.

As shown in FIG. 4, the sorter 2 is used in combination with an image forming machine 148 such as an electrostatic copier. The image forming machine 148 (its left side only shown in FIG. 4) has a housing 158 the left side of which is in the form of inverted stairs having a protruded upper portion and a retracted lower portion. In other words, the left side of the housing 158 includes the protruded upper left side wall 160, and the retracted lower left side wall 162. A sheet discharging outlet 164 is provided in the middle portion of the lower left side wall 162. In the housing 158, there are provided a pair of sheet discharging rollers 166 at the upstream side of the sheet discharging outlet 164.

The upstream portion of the sorter 2; that is, the box-shaped member 6 of the supporting frame 4, and a cover member 134 fitted to the box-shaped member 6 are inserted below the protruded upper portion of the image forming machine 148, so that the sorter 2 is engaged with the image forming machine 148 as required. As a result, the protrusions of the pair of guide boards 8 and 10 enter the housing 158 through the sheet discharging outlet 164 to confront the pair of sheet discharging rollers 166. Accordingly, a sheet fed to the left side (in FIG. 4) by the sheet discharging rollers 166 in the image forming machine 148 is allowed to go in between the pair of guide boards 8 and 10, so that it is introduced into the sorter 2 while being guided by the guide boards 8 and 10.

The sheet thus introduced is further moved to the left side (in FIG. 4) by the pairs of rollers 36 and 44. In the case where, in the sorter 2, the bin trays 56A through 56E are held at the initial positions as indicated by the solid lined in FIG. 4, the sheet delivered through the pairs of rollers 36 and 44 is distributed into the uppermost bin tray 56A. When the bin trays 56A through 56E are at the initial positions as described above, the front and rear cam members of the shifting mechanism 87 are at the initial positions as shown in FIG. 7. In each of the cam members, the angular position of the cam 92 is so adjusted in advance that, when the cam member is at the initial position, the maximumly protruded angular position part 98 is located below the protruded portion 86A of the bin tray 56A approaching or contacting it. Further, the position of the cam 92 in the widthwise direction is so determined in advance that the maximumly protruded angular position part 98 can contact the protruded portion 86A of the uppermost bin tray 56 (protruding more inwardly in the widthwise direction than the end of the protruded portion 86A), and the minimumly protruded angular position part 96 cannot contact the protruded portion 86A of the uppermost bin tray 56A (being positioned outside the protruded portion 86A). Accordingly, the cam 92 does not act on the protruded portion 86A of the uppermost bin tray 56A yet at all.

Figure 8:
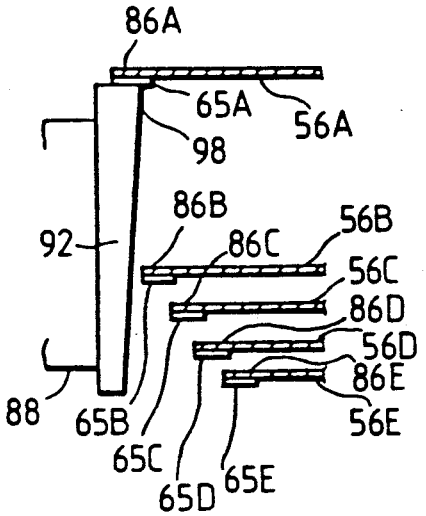

In order to distribute the sheet delivered through the rollers 36 and 44 into the second bin tray 56B located below the uppermost bin tray 56A, the drive source 122 is rotated in the forward direction for a predetermined period of time, so that the front and rear cam members 88 are allowed to make substantially one revolution in the direction of the arrows 114. When the front and rear cam members 88 are rotated one revolution in the direction of the arrows 114, in each of the cam members, the maximumly protruded angular position parts 98 of the cams 92 act on the noise eliminating members 65A provided on the lower surfaces of the protruded portions 86A of the first or uppermost bin tray 56A. As a result, as the maximumly protruded angular position parts 98 of the cams 92 are rotated, the upstream portion of the first bin tray 56A is lifted as shown in FIG. 8; i.e., the bin tray 56A is positioned as indicated by the two-dot chain line in FIG. 4. In the case where the noise eliminating members 97 are provided for the maximumly protruded angular position parts 98 of the cams 92, the latter 92 are abutted against the protruded portions 86A of the bin tray 56A through the noise eliminating members 65A and 97 to thereby prevent noises more sufficiently.

As the front and rear cam members 88 are rotated in the direction of the arrows 114, they are moved inwardly through the cooperation of the male-thread of the stationary male-threaded rods 108 and the female-thread of the cam members 88. Hence, as the cam 92 is further rotated in the direction of the arrow 114 from its position shown in the FIG. 8, the maximumly protruded angular position part 98 of the cam 92 is moved downwardly from the noise eliminating member 65A provided on the lower surface of the protruded portion 86A of the first bin tray 56A; however, the protruded portions 86A of the first bin tray 56A are kept held by the cylindrical outer walls of the cams 92; that is, the first bin tray 56A is kept held at the upper position as indicated in FIG. 8.

As the front and rear cam members 88 are further rotated, they are moved inwardly so that the maximumly protruded angular position parts 98 of the cams 92 can contact the noise eliminating members 65B provided on the lower surfaces of the protruded portions 86B of the second bin tray 56B located just below the first bin tray 56A. As a result, the maximumly protruded angular position parts 98 of the cams 92 act on the protruded portions 86B of the second bin tray 56B to lift the latter 56B as shown in FIG. 9.

Figure 9:
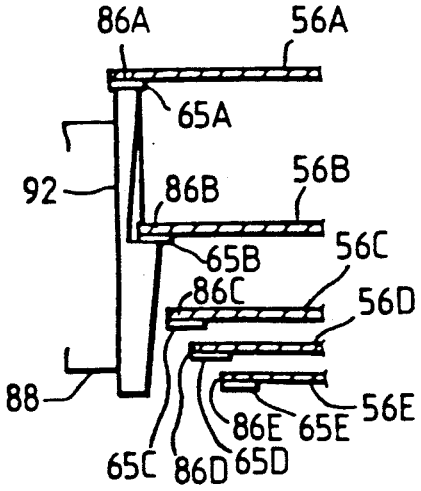

The height of the protruded portions 86B of the second bin tray 56B in FIG. 9 is substantially equal to that of the protruded portions 86A of the first bin tray 56A in FIG. 7. As is apparent from comparison of FIGS. 7 and 9, when the front and rear cam members 88 are rotated one revolution in the direction of the arrow 114, they are each moved by the predetermined distance x ($x=y=l_{max}-l_{min}$) inwardly; that is, they are moved towards each other. Thus, the position of the cam 92 with respect to the protruded portion 86B of the second bin tray 56B in FIG. 9 corresponds to the position of the cam 92 with respect to the protruded portion 86A of the first bin tray 56A in FIG. 7. When the upstream end portion of the first bin tray 56A has been lifted relatively greatly and the upstream end portion of the second bin tray 56B is slightly lifted in the above-described manner, the upstream end portion of the second bin tray 56B is located below the nipping regions of the pairs of rollers 36 and 44 while the upstream end portion of the first bin tray 56A is located above the nipping regions. Therefore, the sheet conveyed by the rollers 36 and 44 is delivered into the second bin tray 56B.

Figure 10:
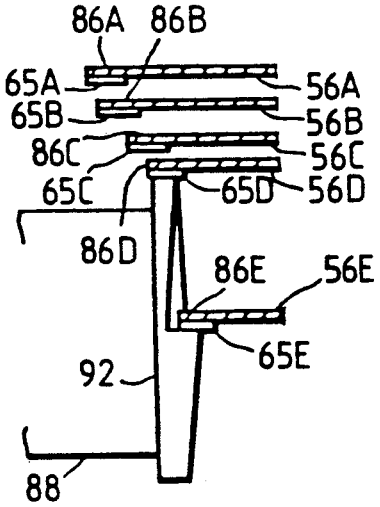

By carrying out the above-described operation repeatedly, the sheet can be delivered into the third, fourth or fifth bin tray. The sheet is delivered into the fifth bin tray 56E as shown in FIG. 10.

As described above, when the cam members 88 lift the bin trays 56A through 56E, the cam members 88 act on the protruded portions 86A through 86E of the bin trays through the noise eliminating members each of which is provided at least one of the lower surface of the protruded portion of each bin tray and the maximumly protruded angular position part of each cam. This will prevent the production of noises which otherwise may be caused when the cam members act on the protruded portions 86A through 86E.

When, in contrast to the above-described operation, the drive source 122 is rotated in the reverse direction to rotate the front and rear cam members 88 in the opposite direction; i.e., in the direction of the arrows 188, then the bin trays 56A through 56E are moved down one after another. When, under the condition that the sheet is distributed into the lowermost or fifth bin tray 56E as shown in FIG. 10, the front and rear cam members 88 are rotated in the direction of the arrows 118, the cams 92 are moved away from each other while rotating in the same direction (the direction of the arrow 118). As a result, the lowermost bin tray 56E is somewhat lowered, and the fourth bin tray 56D located just above the lowermost bin tray 56E is lowered relatively greatly, so that the sheet discharged through the pairs of rollers 36 and 44 is delivered into the fourth bin tray 56D.

By repeatedly carried out the above-described operation, the sheet can be delivered in the third, second or first bin trays.

In the case where, in moving the bin trays downwardly as described above, the bin trays 56A through 56D are held by the cylindrical outer walls of the cams 92, the protruded portions 86D of the bin tray 56D are in contact with the cylindrical outer walls of the cams 92, while those of the remaining bin trays 56A, 56B and 56C are not in contact therewith and are located above the bin tray 56D. In order to lower the bin tray 56D, the cam members 88 are rotated in the direction opposite to the direction in which they are rotated to lift the bin trays. As the cam members 88 are rotated, the protruded portions 86D of the bin tray 56D, being left from the cylindrical outer walls of the cams 92, are caused to ride on the maximumly protruded angular position parts 98 of the cams 92 and to be moved downwardly. As the bin tray 56D is moved downwardly, the protruded portions 86C of the bin tray 56C located above the bin tray 56D are caused to abut against the cylindrical outer walls of the cams 92. In this operation, the production of noises is prevented because the noise eliminating members 65C are provided on the lower surfaces of the protruded portions 86C of the bin tray 56C.

In the above-described sorter, the production of noises caused when the bin trays are brought into contact with the cams is prevented. The same effect can be obtained by providing noise eliminating members in the supporting frame units (holders) which are provided at the downstream end portions of the bin trays as shown in FIG. 12; that is, the production of noises which otherwise may be caused when the end portions of the bin trays are abutted against the walls of the supporting frame units (holders) can be prevented by the provision of the noise eliminating members.

Figure 12:
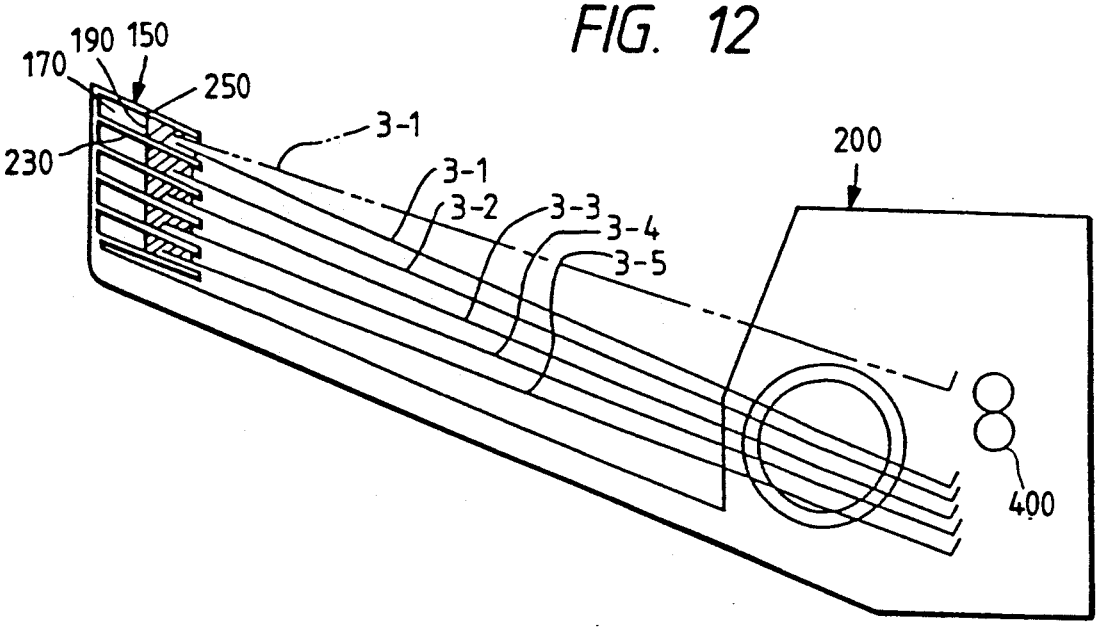
FIG. 12 is a cross-sectional view showing a sorter with a holder including elastic members therein.

In FIG. 12, the end portions of bin trays 3-1 through 3-5 are inserted into the receiving spaces 170 provided in a holder 150. Each of the receiving spaces 170 are defined by two walls, namely, upper and lower walls 250 and 230. The downstream ends of the bin trays 3-1 through 3-5 are in contact with the lower walls 230. Elastic members 190 made of sponge or the like are arranged in the receiving spaces 170 so that the bin trays 3-1 through 3-5 are forced downwardly by the elastic members 190. When, in the sorter thus constructed, the bin trays 3-1 through 3-5 are moved up or down, the vibration of the bin trays is absorbed by the elastic members 190.

Figure 13:
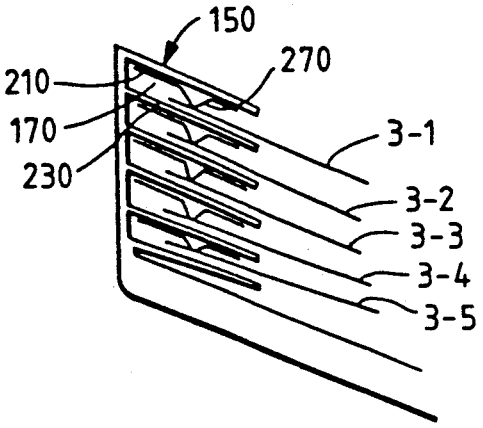
FIG. 13 is a holder including another elastic members.

FIG. 13 shows one modification of the holder 150. In this modification, leaf spring members 210 having protrusions 270 are inserted into the receiving spaces 170 in such a manner that the bin trays 3-1 through 3-5 laid on the lower walls 230 are energized downwardly with the protrusions 270.

As described above, in the sorter according to the invention, the noise eliminating members and/or the elastic members are provided at the contact regions of the cams and the bin trays, and/or at the contact regions of the end portions of the bin trays and the holder, thus preventing the production of noises which otherwise may be caused when the cams abut against the bin tray or the end of the bin tray strikes against the holder.

What is claimed is:

1. A sorter comprising a plurality of movable bin trays vertically arranged, shifting means for moving said bin trays upwardly or downwardly one after another, and noise eliminating means for eliminating noise between a first contacting portion and second contacting portion said noise eliminating being provided in at least one portion of said first contacting portion of said shifting means which contacts said bin trays and said second contacting portion of each of said bin trays which contacts said shifting means.

2. A sorter as claimed in claim 1, wherein said bin trays have protruded portions protruding in a predetermined direction in such a manner that said protruded portions are larger in the length of protrusion from the lowermost bin tray towards the uppermost bin tray, and wherein said noise eliminating means is provided at the lower surfaces of said protruded portions.

3. A sorter as claimed in claim 1, wherein said shifting means is confronted with said lower surfaces of said bin trays, and is arranged rotatably around a central axis extended in said predetermined direction and movably along said central axis, thereby moving upwardly or downwardly said bin trays in synchronization with the rotation of said shifting means.

4. A sorter as claimed in claim 3, wherein said shifting means comprises cam means whose protrusion length along said central axis is gradually increased from a predetermined angular position and drive means for rotating said cam means in one direction to move said cam means towards each other along said central axis and rotating said cam means in the opposite direction to move said cam means away from each other along said central axis.

5. A sorter as claimed in claim 4, wherein said first contacting portion of said shifting means is a maximumly protruded part of said cam means and said noise eliminating means is provided at said maximumly protruded part.

6. A sorter as claimed in claim 4, wherein said cam means comprises an annular plate, a ring-shaped cam formed on one surface of said annular plate and gradually increased in projection length along a predetermined rotational direction, a cylindrical support formed on the other surface of said annular plate and having a female-threaded inner wall and a gear formed on the outer wall, and a male-threaded rod having a fixed flange and a male-threaded outer wall for engaging with said female-threaded inner wall of said of said cylindrical support, the front and rear movement of said cam means being performed by rotation of said gear.

7. A sorter as claimed in claim 1, wherein said noise eliminating means comprises polyurethane rubber.

8. A sorter comprising plural bin trays being vertically arranged, shifting means for moving one end of each of said bin trays upwardly or downwardly one after another and holding means for accommodating the other end of said bin trays, said holding means comprising elastic members for preventing the vibration of said bin trays but allowing movement of said bin trays in the vertical direction.

9. A sorter as claimed in claim 8, wherein said holding means includes plural receiving spaces each of which accommodates each of the other ends of said bin trays and defined by an upper wall and a lower wall.

10. A sorter as claimed in claim 8, wherein said elastic members comprise sponge.

11. A sorter as claimed in claim 8, wherein said elastic members comprise leaf springs.

12. A sorter as claimed in claim 8, wherein said other end of said bin trays are forced to a lower wall of said holding means.

13. In a sorter comprising a plurality of vertically arranged movable bin trays and a shifting mechanism for elevating and lowering the bin trays successively, each bin tray comprising a bin tray body portion and a protruded portion being projected in a predetermined direction from said bin tray body portion, the projecting lengths of the protruded portion being increased step wise from the bottom bin tray to the top bin tray, said shifting means mechanism comprising at least one ring-like cam being disposed opposite to the protruded portion and being free to engage said protruded portion and driving means for rotating said cam in a predetermined rotating direction, said ring-like cam rotating about a central axis which extends in said predetermined direction and moving in the direction of said central axis, the length of said ring like cam being extended in the forward direction of said central axis, said length being progressively increased from a given angular point in a predetermined rotating direction, said driving means causing said cam to move in the forward direction of said central axis, and rotating said cam in a reverse rotating direction, said ring-like cam being rotated in a reverse direction to move in a rearward direction of said central axis, said ring-like cam comprising a first contacting portion for contacting said protruded portion, said protruded portion comprising a second contacting portion for contacting said ring-like cam, the improvement comprises noise eliminating means for eliminating noise between said first contacting portion and said second contacting portion, said noise eliminating means being provided in said first contacting portion and said second contacting portion.

14. A sorter comprising a plurality of movable bin trays being vertically arranged, shifting means for moving said bin trays upwardly or downwardly one after another, and noise eliminating means for eliminating noise between a first contacting portion and second contacting portion, said noise eliminating means being provided in at least one portion of said first contacting portion of said shifting means which contacts said bin trays and said second contacting portion of each of said bin trays which contacts said shifting means, said shifting means being confronted with said lower surfaces of said bin trays, and being arranged rotatably around a central axis extended in said predetermined direction and movably along said central axis, thereby moving upwardly or downwardly said bin trays in synchronization with rotation of said shifting means, said shifting means comprising cam means whose protrusion length along said central axis is gradually increased from a predetermined angular position and drive means for rotating said cam means in one direction to move said cam means towards each other along said central axis and rotating said cam means in the opposite direction to move said cam means away from each other along said central axis, said second contacting portion of each bin trays being the lower surface thereof.

15. A sorter comprising:

a plurality of movable bin trays being vertically arranged, each bin tray comprising a bin tray body portion and a protruded portion, said protruded portion being projected in a predetermined direction from said bin tray body portion, the projecting lengths of the protruded portions being increased stepwise from the bottom movable bin tray to the top movable bin tray;

shifting means for moving said movable bin trays upwardly or downwardly one after another, said shifting means comprising at least one ring-like cam disposed opposite to the protruded portion, said ring-like cam being free to engage said protruded portion, said ring-like cam being rotated about a central axis which extends in a predetermined rotating direction to move said ring-like cam in a forward direction along said central axis, a length of said ring-like cam being extended in the forward direction along said central axis, said length being progressively increased from a predetermined angular point in the predetermined rotating direction, said ring-like cam being rotated in a reverse direction to move said ring-like cam in a backward direction about said central axis, and driving means for rotating said ring-like cam in said predetermined rotating direction to move said ring-like cam in the forward direction along said central axis, and for rotating said ring-like cam in a reverse rotating direction to move said ring-like cam in said backward direction about said central axis; and noise eliminating means for eliminating noise between said bin trays and said ring-like cam, said noise eliminating means being provided on the back surface of said protruded portion of each of said bin trays so that said noise eliminating means abut a maximumly protruded angular portion of the ring-like cam and a cylindrical outer wall of the ring-like cam.

* * * * *